US006026713A

United States Patent [19]

Ohmori et al.

[11] Patent Number: 6,026,713

[45] Date of Patent: Feb. 22, 2000

[54] PNEUMATICALLY OPERATED SCREW DRIVER

[75] Inventors: Yasuki Ohmori; Yasuo Sasaki; Mitsuo Ogura; Michio Wakabayashi, all of Hitachinaka; Akira Uno, Hitachioota; Hiroyasu Ishikawa, Hitachinaka, all of Japan

[73] Assignee: Hitachi Koki Co., Ltd., Tokyo, Japan

[21] Appl. No.: 09/106,713

[22] Filed: Jun. 29, 1998

[30] Foreign Application Priority Data

| | | | |
|---|---|---|---|
| Jul. 4, 1997 | [JP] | Japan | 9-179789 |
| Feb. 19, 1998 | [JP] | Japan | 10-037530 |
| Apr. 17, 1998 | [JP] | Japan | 10-107210 |

[51] Int. Cl.[7] ..... B25B 17/00

[52] U.S. Cl. ..... 81/57.44; 81/57.37

[58] Field of Search ..... 81/54, 57.37, 57.44, 81/430, 433, 435; 173/93.5, 220

[56] References Cited

U.S. PATENT DOCUMENTS

| | | | |
|---|---|---|---|
| 2,818,893 | 1/1958 | Shaff | 81/430 |
| 5,231,902 | 8/1993 | Uno et al. | 81/57.44 |
| 5,730,035 | 3/1998 | Ohmori et al. | 81/57.44 |
| 5,862,724 | 1/1999 | Arata et al. | 81/434 |

FOREIGN PATENT DOCUMENTS

| | | |
|---|---|---|
| 338406 | 10/1989 | European Pat. Off. . |
| 2336599 | 11/1975 | Germany . |
| 4219032 | 12/1992 | Germany . |
| 64-45579 | 2/1989 | Japan . |
| 5-261676 | 10/1993 | Japan . |

*Primary Examiner*—James G. Smith
*Assistant Examiner*—David B. Thomas
*Attorney, Agent, or Firm*—Louis Woo

[57] ABSTRACT

An air motor has a rotor rotatable in response to the pressure of pressurized air. A cylindrical rotary member is connected to the air motor for causing a rotation in synchronism with the rotation of the rotor. A rotary slider is slidable in the axial direction along the inner cylindrical wall of the rotary member. A rotational force transmitting mechanism is provided for transmitting the rotation of the rotary member to the rotary slider. A shaft has one end fixed to the rotary slider and the other end equipped with a piston and a driver bit holder. The rotational and axial motion of the rotary slider is transmitted to a driver bit held in the driver bit holder. And, a cylinder guides the axial slide movement of the piston responsive to the pressure of pressurized air applied on a pressure-receiving surface of the piston.

11 Claims, 3 Drawing Sheets

9
10
54
51
1
4
53
7
55
5
23
8
22
24
11
14
56
52
12
28
20
26
15
28a
57
30
21
13
58
17
32
31
16
80
18

PNEUMATICALLY OPERATED SCREW DRIVER

BACKGROUND OF THE INVENTION

The present invention relates to a pneumatically operated screw driver preferably used for screwing a threaded fastening member to a woody material or the like.

Various pneumatically operated screw drivers have been conventionally proposed. According to a typical arrangement of the pneumatically operated screw drivers, a driver bit is rotated by an air motor to screw a threaded fastening member. For example, the Japanese Patent Application Kokai No. Hei 64-45579 discloses a screw driver having a driver bit moving downward together with an air motor. The Japanese Patent Application Kokai No. Hei 5-261676, corresponding to the U.S. Pat. No. 5,231,902 (DEP 4219032), discloses another type of screw driver having a driver bit moving downward independent of a stationary air motor.

SUMMARY OF THE INVENTION

An object of the present invention is to provide a pneumatically operated screw driver compact in size, reliable in operation, and excellent in operability.

In order to accomplish this and other related objects, a first aspect of the present invention provides a pneumatically operated screw driver comprising an air motor in which a rotor is rotatable in response to the pressure of pressurized air. A cylindrical rotary member is connected to the air motor for causing a rotation in synchronism with the rotation of the rotor. A rotary slider is slidable in the axial direction along the inner cylindrical wall of the rotary member. A rotational force transmitting mechanism is provided for transmitting the rotation of the rotary member to the rotary slider. A shaft has one end fixed to the rotary slider and the other end equipped with a piston and a driver bit holder. A rotational and axial motion of the rotary slider is transmitted to a driver bit held in the driver bit holder. And, a cylinder guides the axial slide movement of the piston responsive to the pressure of pressurized air applied on a pressure-receiving surface of the piston.

Preferably, the rotational force transmitting mechanism is a serration formed by at least one pair of a recess and a protrusion.

Preferably, the rotation of the air motor is transmitted to the rotary member via a planetary gear unit serving as a speed-reduction mechanism.

A second aspect of the present invention provides another pneumatically operated screw driver comprising the motor in which the rotor is rotatable in response to the pressure of pressurized air. The rotary slider is rotated by the air motor and slidable in the axial direction. The shaft has one end fixed to the rotary slider and the other end equipped with the piston and the driver bit holder for transmitting the rotational and axial motion of the rotary slider to the driver bit held in the driver bit holder. The cylinder allows the axial slide movement of the piston responsive to the pressure of pressurized air applied on the pressure-receiving surface of the piston. The cylinder has a pressurized air outlet and a pressurized air inlet. A returning accumulator chamber is provided for storing the pressurized air discharged from the pressurized air outlet of the cylinder. The pressurized air is returned into the cylinder via the pressurized air inlet to generate an air pressure for returning the driver bit and the shaft to their original positions. And, an air passage is provided for supplying the pressurized air to the air motor.

The air passage is closed by the rotary slider when the driver bit positions the dead end of its axial screwing stroke, thereby stopping the pressurized air supplied to the air motor.

Preferably, the pressurized air outlet is provided at a position where the piston passes immediately before the driver bit reaches the dead end of the axial screwing stroke.

Preferably, the cylinder has the inside wall having an enlarged diameter at one end where a seal member of the rotary slider is slidably coupled. The inside wall of the cylinder has a smaller diameter at the other portion where a seal member of the piston is slidably coupled.

Preferably, a through hole extends across the rotary slider and a one-way valve is provided to close the through hole, thereby preventing the pressurized air in the cylinder from leaking through the through hole.

Preferably, a piston damper is provided near the pressurized air inlet. The piston damper has an axial bore through which the driver bit slides in the axial direction. A seal member is provided in the axial bore of the piston damper to seal the clearance between the driver bit and the piston damper.

Furthermore, it is preferable that the driver bit has a larger-diameter portion at a portion where the driver bit is inserted into the axial bore of the piston damper.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENT

Figure 1:
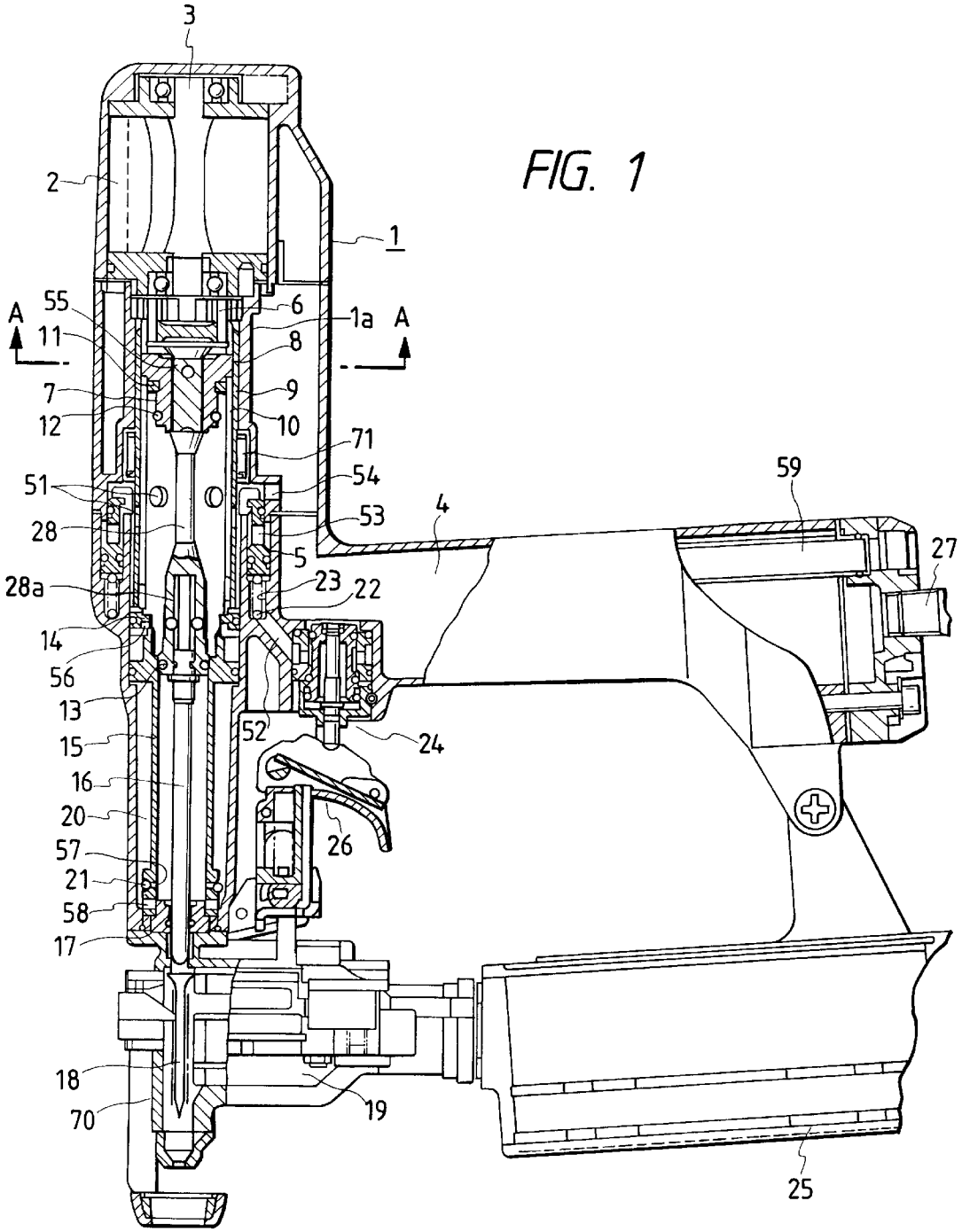
FIG. 1 is a cross-sectional side view showing an overall arrangement of a pneumatically operated screw driver in accordance with a preferred embodiment of the present invention.

A preferred embodiment of the present invention will be explained with reference to the attached drawings. Identical parts are denoted by the same reference numerals throughout the views. The directions used in the following explanation are defined based on a screw driver held in a vertical position with a driver bit extending downward and a grip extending rearward. Needless to say, the actual direction of the screw driver will be frequently changed due to its handiness when it is used.

FIGS. 1 to 4 show a preferable embodiment of a pneumatically operated screw driver in accordance with the present invention. A frame body 1 forms an outer shape of the pneumatically operated screw driver. The frame body 1 has an inside space defining an accumulator chamber 4 extending from a grip to an upper body of the pneumatically operated screw driver. The accumulator chamber 4 communicates with an intake port 27 at the rear end (i.e., bottom) thereof for introducing the pressurized air.

An air motor 2 is provided at the top of the upper body. The air motor 2 has a rotor 3 rotatable about its axis when it receives the pressurized air. The rotor 3 engages with a planetary gear unit 6 to transmit the speed-reduced rotation to a rotary member 9. The rotary member 9 causes a rotation in synchronism with the rotation of the rotor 3. The rotary member 9 is a cylinder with a bottom. The rotary member 9 is rotatably supported via a needle bearing 71 by a cylindrical inside wall 1*a* of the frame body 1 extending in the up-and-down direction.

The rotary body 9 has a plurality of ventilation holes 51 provided at the axial central thereof. The inside wall 1*a* of the frame body 1 has a cylindrical groove 23 extending in the up-and-down direction at a portion facing to the holes 51. The groove 23 accommodates a cylindrical main valve 5 with an associated spring 22. The spring 22 urges the main valve 5 upward. The main valve 5 is slidable along the cylindrical wall of the groove 23. The clearance between the main valve 5 and the groove 23 is sealed at the upper and lower ends of the cylindrical side wall of the main valve 5. The main valve 5 has a ventilation hole 53 at an axial center thereof.

The lower end of the groove 23 communicates with a manual operating valve 24 via a passage 52 extending obliquely downward. The upper end of the groove 23 communicates with the accumulator chamber 4 via a passage 54.

Figure 3:
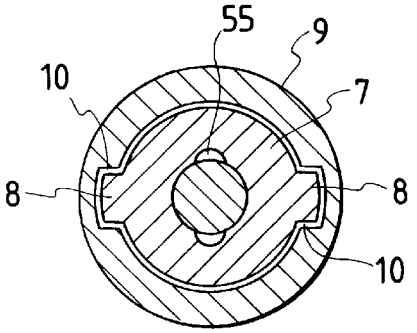
FIG. 3 is a cross-sectional plan view of the pneumatically operated screw driver, taken along a line A—A of FIG. 1.

The rotary member 9 has a pair of recesses 10 extending in the axial direction. A rotary slider 7 is slidably coupled with a cylindrical inside wall of the rotary member 9. The rotary slider 7 has a pair of protrusions 8 engaging with the recesses 10 of the rotary member 9, as shown in FIG. 3. Being guided by the engagement between the recesses 10 and the protrusions 8, the rotary slider 7 is slidable in the axial direction without causing a relative rotation with respect to the rotary member 9.

The rotary slider 7 has an air shut face 11 and is equipped with an O-ring 12 on its outer cylindrical surface. A shaft 28 has an upper end connected to the rotary slider 7. The shaft 28 has an enlarged lower portion having an inside space serving as a driver bit holder 28*a* for holding a driver bit 16. The lowermost end of the enlarged lower portion of the shaft 28 serves as a piston 13. A seal ring 30 is provided on an outer cylindrical surface of the piston 13. With this seal ring 30, the piston 13 is hermetically coupled with the inside wall of a cylinder 15. The piston 13 is slidable in the axial (i.e., up-and-down) direction along the inside wall of the cylinder 15.

A ventilation passage 55 extends across the rotary slider 7 from the upper surface to the lower surface along the gap between the rotary slider 7 and the shaft 28.

A damper plate 14 positions above the cylinder 15. The damper plate 14 is brought into contact with the air shut face 11 of the rotary slider 7 when the rotary slider 7 reached the dead end of its lowering stroke. A ventilation hole 56 opens at a lower portion of the damper plate 14. The hole 56 communicates with an air inlet (not shown) of the air motor 2 via an air passage (not shown).

A piston damper 17 positions below the cylinder 15. Two ventilation holes 57 and 58 open at the lower end of the cylinder 15. The upper hole 57 serves as a pressurized air outlet while the lower hole 58 serves as a pressurized air inlet. The upper hole (i.e., pressurized air outlet) 57 is axially offset from the lower hole (i.e., pressurized air inlet ) 58. The piston 13 moves downward during an axial screwing stroke of the driver bit 16. When the shut face 11 of the rotary slider 7 hits the damper plate 14, the piston 13 is stopped at the dead end of the axial screwing stroke of the driver bit 16. At this moment, the upper hole (i.e., pressurized air outlet) 57 positions above the seal ring 30 and the lower hole (i.e., pressurized air inlet) 58 positions below the seal ring 30.

An O-ring 21, acting as a one-way valve, is provided outside the hole 57. A cylindrical space defined by the outer wall of the cylinder 15 and an inner wall of the frame body 1 serves as a returning accumulator chamber 20 whose arrangement is well known in a conventional pneumatically operated nailing machine.

A screw feeder 19 positions at the lower end of the frame body 1. The screw feeder 19 is associated with a magazine 25 that accommodates a bundle of screws 18 connected by a band. A screw guide 70 positions just beneath the driver bit 16. The screw feeder 19 successively feeds the screws 18 from the magazine 25 to a predetermined position in the screw guide 70. The driver bit 16 can engage with the top of the screw 18 held in the screw guide 70, when it moves downward. A trigger lever 26 positions above the screw feeder 19. The manual operating valve 24 is linked with this trigger lever 26.

The above-described screw driver operates in the following manner.

The pressurized air is introduced into the accumulator chamber 4 when the pressurized air intake port 27 is connected to a compressor (not shown). Part of the pressurized air flows into the groove 23 via a pressure supply path (not shown) in the manual operating valve 24 and the passage 52. Thus, the lower surface of the main valve 5 receives the pressure of pressurized air. The main valve 5 is moved upward by a composite force of the pressurized air and the spring 22. When the main valve 5 reaches the uppermost position, the upper end of the main valve 5 closes a communication passage connecting the accumulator chamber 4 and the holes 51 of the rotary member 9. Upon closure of this communication passage, no pressurized air is supplied to the piston 13 and the air motor 2.

Figure 2:
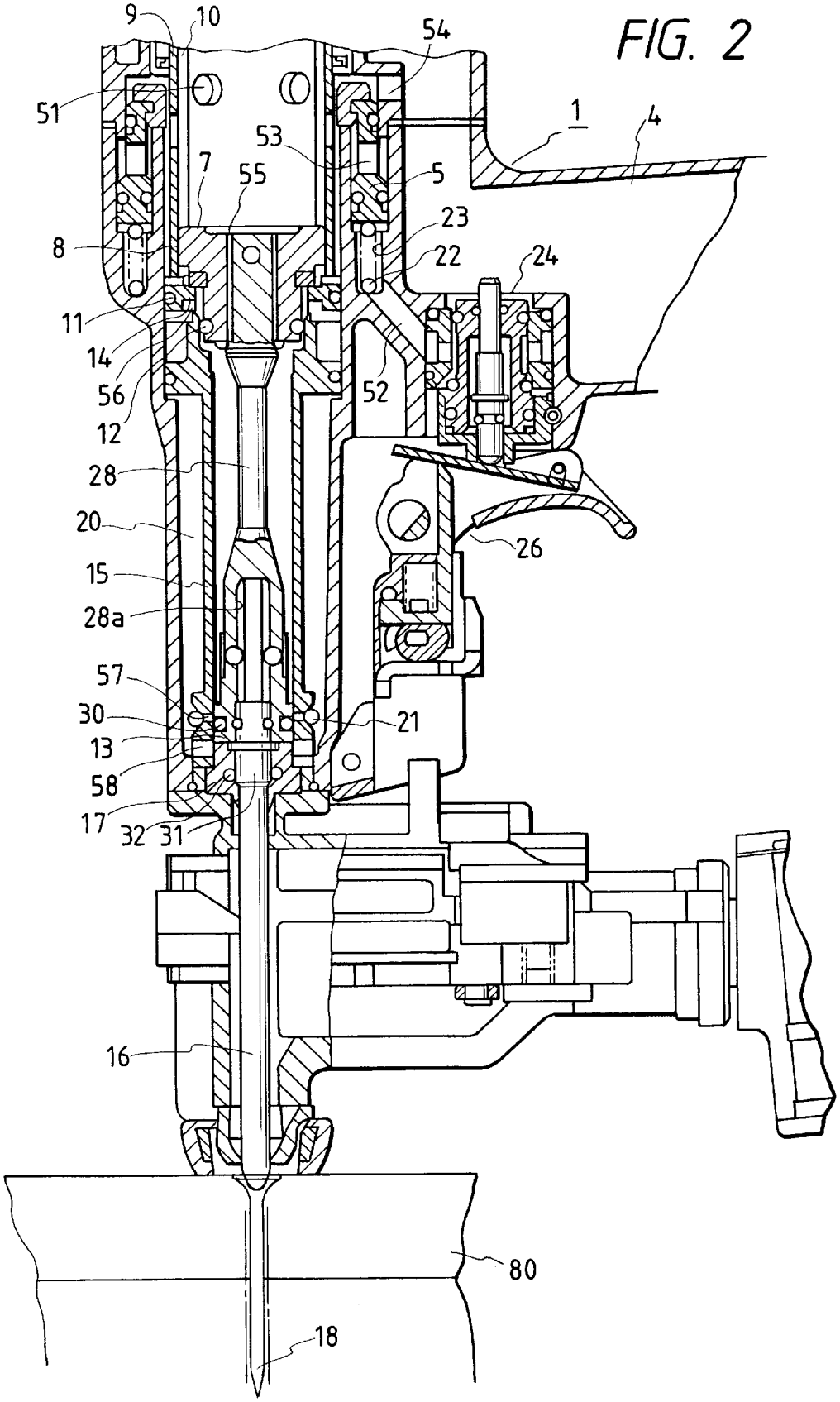
FIG. 2 is a cross-sectional side view showing an operational condition of the pneumatically operated screw driver shown in FIG. 1.

When a user manipulates the trigger lever 26, the manual operating valve 24 shifts upward to discharge or drain the pressurized air residing in the groove 23 via the passage 52 and a pressure relief path (not shown) in the manual operating valve 24. At this moment, the top surface of the main valve 5 receives the downward force exceeding the spring force. This downward force is given by the pressurized air supplied from the accumulator chamber 4 via the passage 54. Thus, the main valve 5 moves downward against the spring force of the spring 22 as shown in FIG. 2.

The lower shift movement of the main valve 5 opens the communication passage connecting the accumulation chamber 4 and the holes 51 of the rotary member 9. Thus, the pressurized air flows into the inside space of the rotary member 9 via the passage 54 and the holes 51 from the accumulator chamber 4.

The upper surface of piston 13 receives the pressure from the pressurized air in the rotary member 9. Being pressed by the pressurized air, the piston 13 moves downward. The air motor 2 communicates with the inside space of the rotary member 9 via the hole 56. The pressurized air is introduced into the air motor 2 from this hole 56. The rotor 3 of the air motor 2 rotates in response to the pressure of the supplied air. The rotation of the rotor 3 is transmitted via the planetary gear unit 6 to the rotary member 9 and the rotary slider 7. The rotary slider 7 rotates together with the rotary member 9 without causing a relative rotation.

The rotary slider 7 is connected with the shaft 28. The piston 13 is integral with the shaft 28. Thus, the rotation of the rotary slider 7 is transmitted to the piston 13, while the piston 13 moves downward. The driver bit 16 is held by the driver bit holder 28*a* formed inside the enlarged lower portion of the shaft 28. The driver bit holder 28*a* is integral with the piston 13. Thus, the driver bit 16 rotates and moves downward together with the piton 13.

In response to the rotational and axial (downward) movement of the driver bit 16, the screw 18 held in the screw guide 70 is removed off the connecting band and screwed into a woody material 80 or the like.

When the driver bit 16 reaches the lowermost end (i.e., the dead end of the axial screwing stroke as shown in FIG. 2), the air shut face 11 of the rotary slider 7 is brought into contact with the damper plate 14. Thus, the piston 13 is stopped. The O-ring 12 is provided on the outer surface of the rotary slider 7. In this condition, the O-ring 12 seals the upper end of the inner cylindrical wall of the cylinder 15. The air shut face 11 closes the hole 56. Upon closing the hole 56, no pressurized air flows into the air motor 2. The rotor 3 in the air motor 2 rapidly decreases its speed and stops completely. All of the planetary gear unit 6, the rotary member 9, the rotary slider 7, the piston 13 and the driver bit 16 decelerate in response to the rotation of the rotor 3 and stop.

In this condition, the pressurized air in the accumulator chamber 4 flows into the returning accumulator chamber 20 from the accumulator chamber 4 via the passage 54, the holes 51, the upper chamber of the rotary slider 7, the passage 55, the hole (i.e., pressurized air outlet) 57 and the O-ring (i.e., the one-way valve) 21. Furthermore, the hole (i.e., pressurized air inlet) 58 allows the pressurized air acting on the lower surface of the piston 13.

When the lower surface of the piston 13 is brought into contact with the upper surface of the piston damper 17, the lower surface of the piston 13 has a pressure-receiving area smaller than that of the upper surface of the piston 13. Thus, the piston 13 firmly contacts with the piston damper 17 due to a pressure difference between the upper and lower surfaces of the piston 13.

FIG. 2 shows the piston 13 positioned at the lowermost end immediately after the seal ring 30 of the piston 13 passed the hole 57. Before the seal ring 30 passes the hole 57, no pressurized air flows into the returning accumulator chamber 20 and no pressure of the pressurized air acts on the lower surface of the piston 13. A large pressure difference is caused between the upper and lower surfaces of the piston 13. Thus, the piston 13 is strongly pressed by this large pressure difference.

When the user returns or releases the manual operating valve 24, the pressurized air of the accumulator chamber 4 flows into the groove 23 via the pressure supply path (not shown) in the manual operating valve 24 and the passage 52. The lower surface of the main valve 5 receives the supplied pressurized air. The main valve 5 moves upward. When the main valve 5 reaches the uppermost position, the upper end of the main valve 5 closes the communication passage connecting the accumulator chamber 4 and the holes 51 of the rotary member 9. Upon closure of the communication passage by the main valve 5, no pressurized air is supplied to the piston 13 and the air motor 2. At this moment, the hole 53 formed at the axial center of the main valve 5 communicates with a discharge passage 59 via a passage (not shown) so as to establish a pressurized air drain path.

On the other hand, the O-ring (i.e., the one-way valve) 21 closes the hole 57. In other words, the O-ring 21 prevents the pressurized air remaining in the returning accumulator chamber 20 from flowing into the cylinder 15 via the hole 57. Thus, a significant amount of air pressure still acts on the lower surface of the piston 13. By receiving this air pressure, the piston 13 moves upward to the uppermost position. Thus, the driver bit 16 returns its original or home position, as shown in FIG. 1.

In this case, the pressurized air confined in the cylinder 15 generates an assist force for lifting the piston 13 upward. This assist force is provided by a stepped inner cylindrical wall arrangement of the cylinder 15 in accordance with the preferred embodiment of the present invention.

Figure 4:
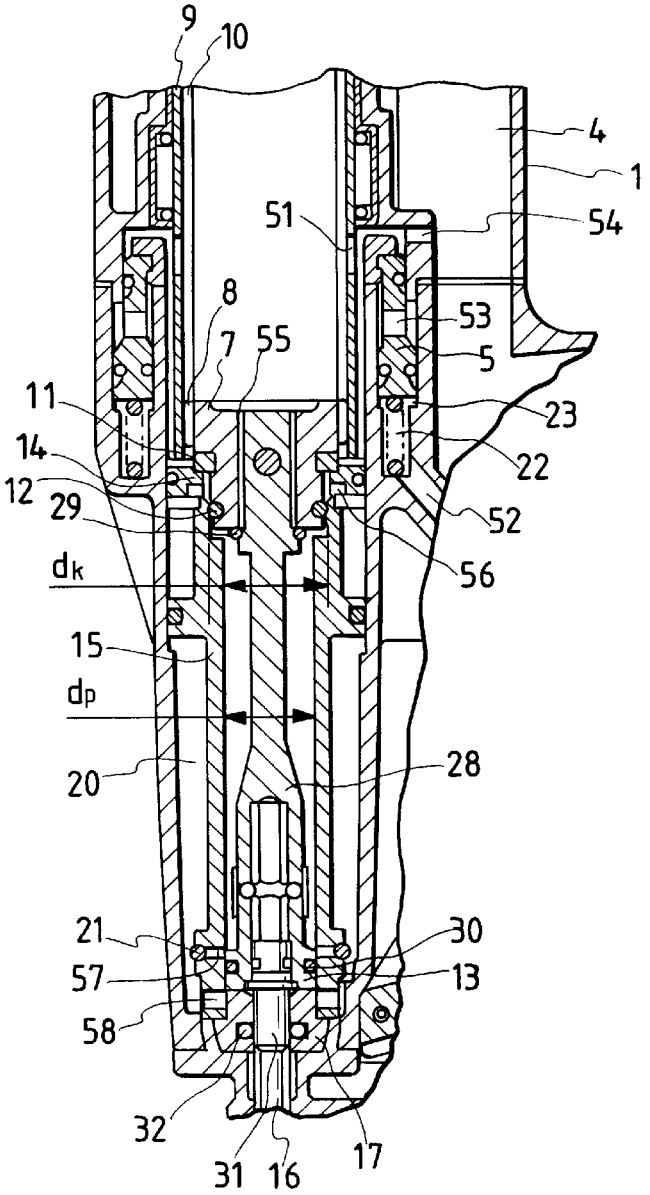
FIG. 4 is a cross-sectional side view showing a characteristic structure of a slider provided in the pneumatically operated screw driver shown in FIG. 1.

As shown in FIG. 4, the cylinder 15 has an inner diameter "dk" at the upper end portion where the O-ring 12 of the rotary slider 7 is slidably coupled. The cylinder 15 has an inner diameter "dp" at the other portion where the seal ring 30 of the piston 13 is slidably coupled. The diameter "dk" is larger than the diameter "dp."

Furthermore, an O-ring 29 is provided at the lower end of the passage 55 of the rotary slider 7. The O-ring 29 acts as a one-way valve.

When the manual operating valve 24 is returned, the pressurized air in the rotary member 9 is discharged as described above. However, the O-ring 29 confines the pressurized air in the cylinder 15 without discharging it via the passage 55 to the rotary slider 7.

When "P1" denotes the pressure of the confined air in the cylinder 15, the lower surface of the rotary slider 7 receives a force $F=\Delta S \cdot P1$ acting upward. $\Delta S$ is an area difference between the upper and lower cross sections of the cylinder 15 and is represented by $\pi \cdot (dk^2 - dp^2)/4$. Thus, the assist force $F=\Delta S \cdot P1$ is added to the rotary slider 17. The rotary slider 17 can receive an increased or boosted driving force at the initial stage of its returning stroke to the original position.

Furthermore, the assist force added by the cylinder 15 can be effectively used to forcibly disengage the driver bit 16 from the screw 18 when they stick together.

Furthermore, according to the preferred embodiment of the present invention, the driver bit 16 has a larger-diameter portion 31 at a portion where the driver bit 16 is inserted into an axial bore of the piston damper 17. The driver bit 16 slides in the up-and-down direction through the axial bore of the piston damper 17. At an axial center of this bore, a O-ring 32 is provided. The larger-diameter portion 31 is brought into contact with the O-ring 32 before the air shut face 11 of the rotary slider 7 is brought into contact with the damper plate 14.

This arrangement effectively prevents the pressurized air in the returning accumulator chamber 20 from leaking out of the screw driver via a clearance between the driver bit 16 and axial bore of the piston damper 17 even when the sealing between the piston 13 and the piston damper 17 is insufficient. Thus, the piston 13 and the driver bit 16 can return upward without causing any leakage of the pressurized air applied to the lower surface of the piston 13.

Furthermore, the air shut face 11 is brought into contact with the damper plate 14 before the piton 13 is brought into contact with the piston damper 17.

According to the above-described arrangement, no accuracy is required in the manufacturing of the piston 13 and the rotary slider 7. This substantially reduces the manufacturing costs.

While the driver bit 16 returns to the original position, the screw feeder 19 sends the next screw 18 into the screw guide 70.

According to the above-described arrangement, the rotary member 9 and the rotary slider 7 cooperatively constitute a rotational force transmitting mechanism. The rotational force transmitting mechanism is a serration formed by at least one pair of the recess 10 and the protrusion 8. This arrangement is advantageous in that the distance between the rotational force transmitting mechanism (i.e., the serration) and the rotational center can be enlarged. In general, the increased distance from the rotational center reduces the force acting on the serration. This makes it possible to fabricate the rotary member 9 and the rotary slider 7 by a plastic or a comparable cheaper material. Furthermore, the serration is structurally simple and easy to manufacture.

The planetary gear unit 6 reduces the rotational speed of the rotor 3 of the air motor 2 and transmits the increased torque. This makes it possible to use a compact air motor. A compact air motor realizes the downsizing of the screw driver and improves the operability of the screw driver.

Furthermore, using the planetary gear unit 6 as the speed-reduction mechanism makes it possible to coaxially arrange the air motor 2, the rotary member 9, the piston 13 and the driver bit 16. This brings the better balance in the arrangement of the screw driver. The operability of the screw driver can be further improved.

According to the above-described embodiment, the piston 13 is integral with the lower end of the shaft 28. The rotary slider 7 with the air shut face 11 is integral with the upper end of the shaft 28. Thus, the shifting portion constituted by the piston 13, the shaft 28 and the rotary slider 7 is simple in structure and light in weight.

However, it is possible to provide the piston 13 as a separate member being not integral with the shaft 28.

As apparent from the foregoing description, the pneumatically operated screw driver of the preferred embodiment of the present invention comprises the air motor (2) in which the rotor (3) is rotatable in response to the pressure of pressurized air. The cylindrical rotary member (9) is connected to the air motor (2) for causing a rotation in synchronism with the rotation of the rotor (3). The rotary slider (7) is slidable in the axial direction along the inner cylindrical wall of the rotary member (9). The rotational force transmitting mechanism (8, 10) is provided for transmitting the rotation of the rotary member (9) to the rotary slider (7). The shaft (28) has one end fixed to the rotary slider (7) and the other end equipped with the piston (13) and the driver bit holder **(28*a*) for transmitting the rotational and axial motion of the rotary slider (7) to the driver bit (16) held in the driver bit holder (28*a*). And, the cylinder (15) guides the axial slide movement of the piston (13) responsive to the pressure of pressurized air applied on the pressure-receiving surface of the piston (13)**.

More specifically, the rotational force transmitting mechanism is a serration formed by at least one pair of a recess (10) and a protrusion (8). The rotation of the air motor (2) is transmitted to the rotary member (9) via the planetary gear unit (6) serving as the speed-reduction mechanism (6).

Furthermore, the preferred embodiment of the present invention discloses another pneumatically operated screw driver comprises the motor (2) in which the rotor (3) is rotatable in response to the pressure of pressurized air. The rotary slider (7) is rotated by the air motor (2) and slidable in the axial direction. The shaft (28) has one end fixed to the rotary slider (7) and the other end equipped with the piston (13) and the driver bit holder **(28*a*) for transmitting the rotational and axial motion of the rotary slider (7) to the driver bit (16) held in the driver bit holder (28*a*). The cylinder (15) guides the axial slide movement of the piston (13) responsive to the pressure of pressurized air applied on the pressure-receiving surface of the piston (13). The cylinder (15) has the pressurized air outlet (57) and the pressurized air inlet (58). The returning accumulator chamber (20) is provided for storing the pressurized air discharged from the pressurized air outlet (57) of the cylinder (15). The pressurized air is returned into the cylinder (15) via the pressurized air inlet (58) to generate the air pressure for returning the driver bit (16) and the shaft (28) to their original positions. And, the air passage (56) is provided for supplying the pressurized air to the air motor (2). The air passage (56) is closed by the rotary slider (7) when the driver bit (16)** positions the dead end of its axial screwing stroke, thereby stopping the pressurized air supplied to the air motor.

The pressurized air outlet (57) is provided at the position where the piston (13) passes immediately before the driver bit (16) reaches the dead end of the axial screwing stroke. The cylinder (15) has the inside wall having an enlarged diameter (dk) at one end where the seal member (12) of the rotary slider (7) is slidably coupled. The inside wall of the cylinder (15) has a smaller diameter (dp) at the other portion where the seal member (30) of the piston (13) is slidably coupled. The through hole (55) extends across the rotary slider (7) and the one-way valve (29) is provided to close the through hole (55), thereby preventing the pressurized air in the cylinder (15) from leaking through the through hole (55). The piston damper (17) is provided near the pressurized air inlet (58). The piston damper (17) has the axial bore through which the driver bit (16) slides in the axial direction. The seal member (32) is provided in the axial bore of the piston damper (17) to seal the clearance between the driver bit (16) and the piston damper (17). Furthermore, the driver bit (16) has the larger-diameter portion (31) at the portion where the driver bit (16) is inserted into the axial bore of the piston damper (17).

This invention may be embodied in several forms without departing from the spirit of essential characteristics thereof. The present embodiment as described is therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A pneumatically operated screw driver comprising:

an air motor in which a rotor is rotatable in response to the pressure of pressurized air;

a cylindrical rotary member connected to said air motor for causing a rotation in synchronism with the rotation of said rotor;

a rotary slider slidable in an axial direction along an inner cylindrical wall of said rotary member;

a rotational force transmitting mechanism for transmitting the rotation of said rotary member to said rotary slider;

a shaft having one end fixed to said rotary slider and the other end equipped with a piston and a driver bit holder for transmitting a rotational and axial motion of said rotary slider to a driver bit held in said driver bit holder; and a cylinder for allowing an axial slide movement of said piston responsive to the pressure of pressurized air applied on a pressure receiving surface of said piston.

2. The pneumatically operated screw driver in accordance with claim 1, wherein said rotational force transmitting mechanism is a serration formed by at least one pair of a recess and a protrusion.

3. The pneumatically operated screw driver in accordance with claim 1, wherein the rotation of said air motor is transmitted to said rotary member via a speed-reduction mechanism.

4. The pneumatically operated screw driver in accordance with claim 3, wherein the speed-reduction mechanism is a planetary gear unit.

5. A pneumatically operated screw driver comprising:

an air motor in which a rotor is rotatable in response to the pressure of pressurized air;

a rotary slider rotated by said air motor and slidable in an axial direction;

a shaft having one end fixed to said rotary slider and the other end equipped with a piston and a driver bit holder for transmitting a rotational and axial motion of said rotary slider to a driver bit held in said driver bit holder;

a cylinder for allowing an axial slide movement of said piston responsive to the pressure of pressurized air applied on a pressure-receiving surface of said piston, said cylinder having a pressurized air outlet and a pressurized air inlet;

a returning accumulator chamber for storing the pressurized air discharged from said pressurized air outlet of said cylinder and returning said pressurized air into said cylinder via said pressurized air inlet for generating an air pressure for returning said driver bit and said shaft to their original positions; and an air passage for supplying the pressurized air to said air motor, said air passage being closed by said rotary slider when said driver bit positions the dead end of its axial screwing stroke, thereby stopping the pressurized air supplied to said air motor.

6. The pneumatically operated screw driver in accordance with claim 5, wherein said pressurized air outlet is provided at a position where said piston passes immediately before said driver bit reaches said dead end of the axial screwing stroke.

7. The pneumatically operated screw driver in accordance with claim 5, wherein said cylinder has an inside wall having an enlarged diameter at one end where a seal member of said rotary slider is slidably coupled, and said inside wall has a smaller diameter at the other portion where a seal member of said piston is slidably coupled.

8. The pneumatically operated screw driver in accordance with claim 5, wherein a through hole extends across said rotary slider and a one-way valve is provided to close said through hole, thereby preventing the pressurized air in said cylinder from leaking through said through hole.

9. The pneumatically operated screw driver in accordance with claim 5, wherein a piston damper is provided near said pressurized air inlet.

10. The pneumatically operated screw driver in accordance with claim 9, wherein said piston damper has an axial bore through which said driver bit slides in the axial direction, and a seal member is provided in said axial bore of said piston damper to seal a clearance between said driver bit and said piston damper.

11. The pneumatically operated screw driver in accordance with claim 10, wherein said driver bit has a larger-diameter portion at a portion where said driver bit is inserted into said axial bore of the piston damper.

* * * * *